US010581179B2

(12) United States Patent
Yu et al.

(10) Patent No.: US 10,581,179 B2
(45) Date of Patent: Mar. 3, 2020

(54) SYMMETRIC LEAKY WAVE ANTENNA

(71) Applicant: CUBTEK INC., Hsinchu County (TW)

(72) Inventors: San-Chuan Yu, Zhubei (TW); Shyh-Jong Chung, Zhubei (TW); Ching-Han Tsai, Zhubei (TW); Chuan-Ting Kuo, Zhubei (TW); Bo-Yi Wang, Zhubei (TW); Tzu-Chuan Huang, Zhubei (TW)

(73) Assignee: CUBTEK INC., Hsinchu County (TW)

( * ) Notice: Subject to any disclaimer, the term of this patent is extended or adjusted under 35 U.S.C. 154(b) by 60 days.

(21) Appl. No.: 16/042,297

(22) Filed: Jul. 23, 2018

(65) Prior Publication Data

US 2019/0334251 A1 Oct. 31, 2019

(30) Foreign Application Priority Data

Apr. 25, 2018 (TW) ..... 107205397 U

(51) Int. Cl.
*H01Q 21/06* (2006.01)
*H01Q 13/20* (2006.01)
*H01Q 19/18* (2006.01)

(52) U.S. Cl.
CPC ..... *H01Q 21/068* (2013.01); *H01Q 13/20* (2013.01); *H01Q 19/18* (2013.01); *H01Q 21/06* (2013.01)

(58) Field of Classification Search
CPC ..... H01Q 21/068; H01Q 13/20; H01Q 19/18; H01Q 21/06
USPC ..... 343/779
See application file for complete search history.

(56) References Cited

U.S. PATENT DOCUMENTS 5,977,924 A * 11/1999 Takei ..... H01Q 21/068 343/700 MS
8,421,698 B2 * 4/2013 Neto ..... H01Q 13/28 343/770
2010/0156740 A1 * 6/2010 Chang ..... H01Q 1/525 343/843
2011/0248898 A1 10/2011 Rothwell et al.

* cited by examiner

*Primary Examiner* — Hai V Tran
(74) *Attorney, Agent, or Firm* — Muncy, Geissler, Olds & Lowe, PC

(57) ABSTRACT

A symmetric leaky wave antenna includes a dielectric substrate, an electric wall, and two reflection bore arrays. The dielectric substrate has a first and a second metal layers disposed on two opposite faces thereof. The first metal layer has a feed end and two travelling wave sides. The electric wall is disposed between two travelling wave sides, with the two travelling wave sides symmetrically disposed with respect to the electric wall. The two reflection bore arrays are symmetrically disposed along the two travelling wave sides, respectively, with the electric wall arranged at a central line between the two reflection bore arrays. The two reflection bore arrays pass through the first metal layer, the second metal layer, and the dielectric substrate. The reflection bore array and the electric wall reduce the leakage rate of the electromagnetic wave, thus increasing the gain value of the antenna.

11 Claims, 6 Drawing Sheets

SYMMETRIC LEAKY WAVE ANTENNA

BACKGROUND OF THE INVENTION

1. Field of the Invention

The present invention relates to leaky wave antennas, and more particularly, to a leaky wave antenna with symmetric travelling wave structure.

2. Description of the Related Art

A conventional flat transmission line will produce radiation and leakage. A leakage transmission line is designed for a leaky wave antenna, which achieves high directivity and high gain. The transmission angle of the main beam is allowed to be adjustable by varying the frequency. Therefore, the leaky wave antenna is able to be applied to various applications.

Also, according to the property of the leaky wave, the propagation constant of the leaky wave is a complex number ($\gamma=\beta-j\alpha$), wherein the phase constant is $\beta$ and the loss constant is $\alpha$. Therefore, the energy declination of the leaky wave antenna is related to the values of $\alpha$ and $\beta$, the frequency, the thickness of substrate, the dielectric constant, and the width of the microstrip line.

However, parameters of an ordinary leaky wave antenna, such as the values of $\alpha$ and $\beta$, the frequency, the thickness of substrate, and the dielectric constant, are usually decided previously, causing a limitation upon the gain value of the leaky wave antenna. For improving the limitation issue of the gain value, US20110248898A1 discloses a leaky wave antenna, which applies impedance components arranged in an array on the substrate, such that the electromagnetic wave continuously generates radiation along the impedance components, thus lowering the leakage rate and increasing the gain value of the leaky wave antenna.

However, the aforementioned impedance components are disposed along a single side of the substrate, causing an asymmetric radiation pattern (E-plane) issue. As a result, the wave beam of the radiation pattern is unable to focus, and therefore easy to be dissipated, affecting the transmission effect of the leaky wave antenna.

SUMMARY OF THE INVENTION

For improving the issues above, a symmetric leaky wave antenna is disclosed. With two symmetrically disposed reflection bore arrays and an electric wall disposed between the reflection bore arrays, the leakage rate of the electromagnetic wave is lowered, so as to increase the gain value of the symmetric leaky wave antenna of the present invention.

A symmetric leaky wave antenna in accordance with an embodiment of the present invention is provided, comprising:

a dielectric substrate, having a first metal layer disposed on one face of the dielectric substrate and a second metal layer disposed on another face of the dielectric substrate in opposite to the first metal layer, respectively, the first metal layer having a feed end and two travelling wave sides, the two travelling wave sides connected to two ends of the feed ends, respectively, and the two travelling sides extending toward a direction away from the feed end;

an electric wall disposed between two travelling wave sides, with the two travelling wave sides symmetrically disposed with respect to the electric wall; and two reflection bore arrays symmetrically disposed along the two travelling wave sides, respectively, such that the electric wall is arranged at a central line between the two reflection bore arrays; the two reflection bore arrays passing through the first metal layer, the second metal layer, and the dielectric substrate.

With two reflection bore arrays and the electric wall disposed between the two reflection bore arrays, the symmetric leaky wave antenna lowers the leakage rate of the electromagnetic wave, so as to increase the gain value of the symmetric leaky wave antenna.

In addition, the two reflection bore arrays are symmetrically disposed with respect to the electric wall, such that the radiation pattern is symmetrically arranged, so as to focus the wave beam of the radiation pattern, improving the energy transmission. With such configuration, the present invention improves the asymmetric issue of the conventional radiation pattern which causes the incapability of focusing the wave beam. Thus, the dissipation of wave beam is improved.

DETAILED DESCRIPTION OF THE INVENTION

Figure 1:
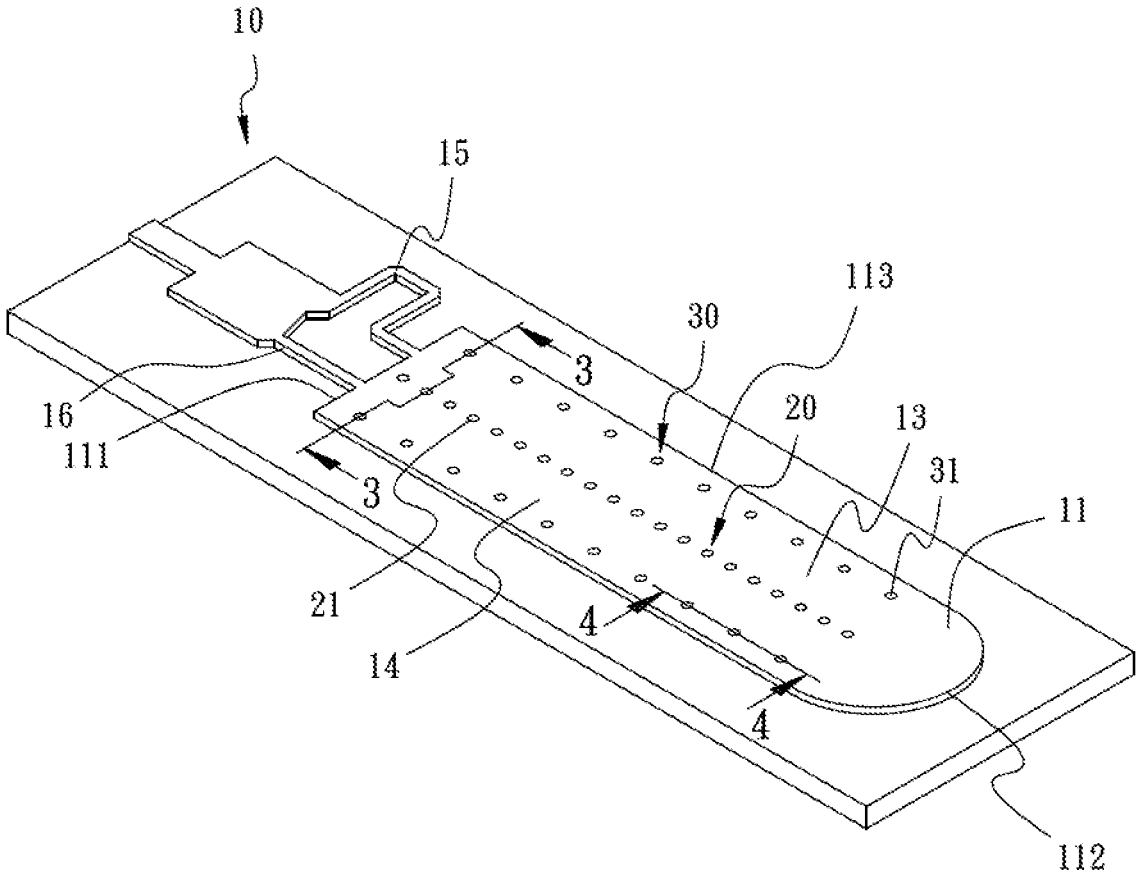
FIG. 1 is a perspective view of the symmetric leaky wave antenna in accordance with the first embodiment of the present invention, illustrating the closed end formed in a semi-circular shape.
Figure 2:
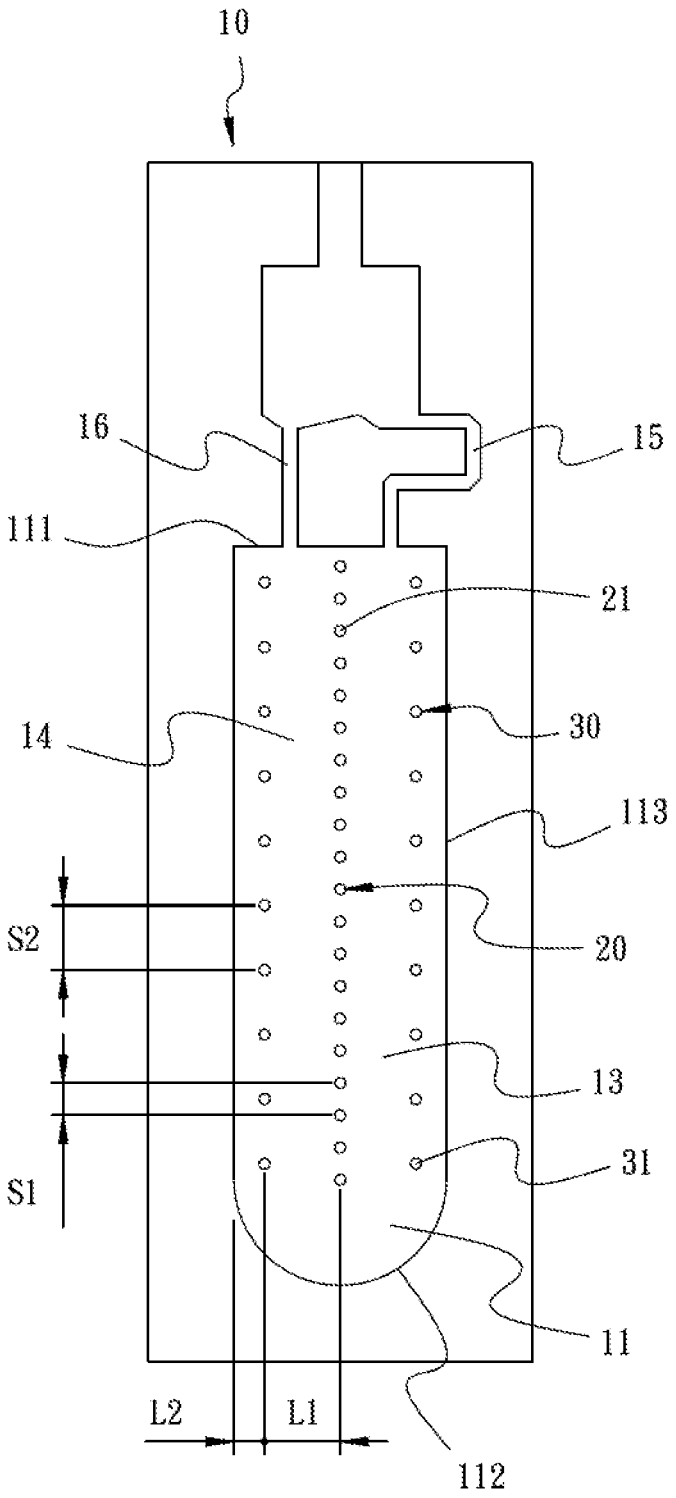
FIG. 2 is a top view of the symmetric leaky wave antenna in accordance with the first embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 6, a symmetric leaky wave antenna in accordance with an embodiment of the present invention comprises a dielectric substrate 10, an electric wall 20, and two reflection bore arrays 30. The electric wall 20 and the two reflection bore arrays 30 are disposed on a lateral face of the dielectric substrate 10. The electric wall 20 is disposed between the two reflection bore arrays 30. With the two reflection bore arrays 30, the leakage rate of electromagnetic wave is lowered, so as to increase the gain value of the leaky wave antenna.

The dielectric substrate 10 has two opposite faces, wherein a first metal layer 11 and an opposite second metal layer 12 are disposed on the two faces, respectively, and the electric wall 20 and the two reflection bore arrays 30 are disposed on the first metal layer 11. A feed end 111 and a closed end 112 are disposed on two ends of the first layer 11, such that two ends of the feed end 111 and the two ends of the closed end 112 are connected by a travelling wave side 113, respectively. Also, the two travelling wave sides 113 extend from the feed end 111 to the closed end 112. In addition, the two travelling wave sides 113 are symmetrically disposed with respect to the electric wall 20. In the embodiments of the present invention, the two travelling wave sides 113 are straight. More particularly, the two reflection bore arrays 30 are applied to reduce the leakage rate of the electromagnetic wave in a direction from the feed end 111 to the closed end 112, such that the leaked electromagnetic wave is radiated and dissipated into the air.

The closed end 112 tapers and is allowed to be formed in an arc shape, a semi-circular shape, or a symmetric angular shape. Referring to FIG. 1, in the first embodiment, the closed end 112 is formed in a semi-circular shape; referring to FIG. 5, in the second embodiment, the closed end 112 is formed in an arc shape; referring to FIG. 6, in the third embodiment, the closed end 112 is formed in an angular shape.

Further, a first antenna channel 13 is formed between one travelling wave side 113 and the electric wall 20, and a second antenna channel 14 is formed between the other travelling wave side 113 and the electric wall 20. Therefore, when the electromagnetic wave passes the first antenna channel 13 and the second antenna channel 14, the radiations produced in first antenna channel 13 and the second antenna channel 14 are nullified with each other at the closed end 112, such that reflection caused by residual energy is prevented.

In addition, the feed end 111 is connected with a first feed line 15 and the second feed line 16, wherein an end of the first feed line 15 is connected to a section of the feed end 111 corresponding to the first antenna channel 13, and an end of the second feed line 16 is connected to a section of the feed end 111 corresponding to the second antenna channel 14, wherein the length of the first feed line 15 is not equal to the length of the second feed line 16. In the embodiments of the present invention, the length of the first feed line 15 is larger than the length of the second feed line 16. Also, the first feed line 15 includes an angle, and the second feed line 16 is straight shaped. With such configuration, the electromagnetic wave is able to enter the first antenna channel 13 through the first feed line 15 to produce a radiation, and also able to enter the second antenna channel 14 through the second feed line 16 to produce a radiation, wherein the shape and length differences between the first feed line 15 and the second feed line 16 will cause a 180 degrees phase difference between the imputed electromagnetic waves.

Figure 3:
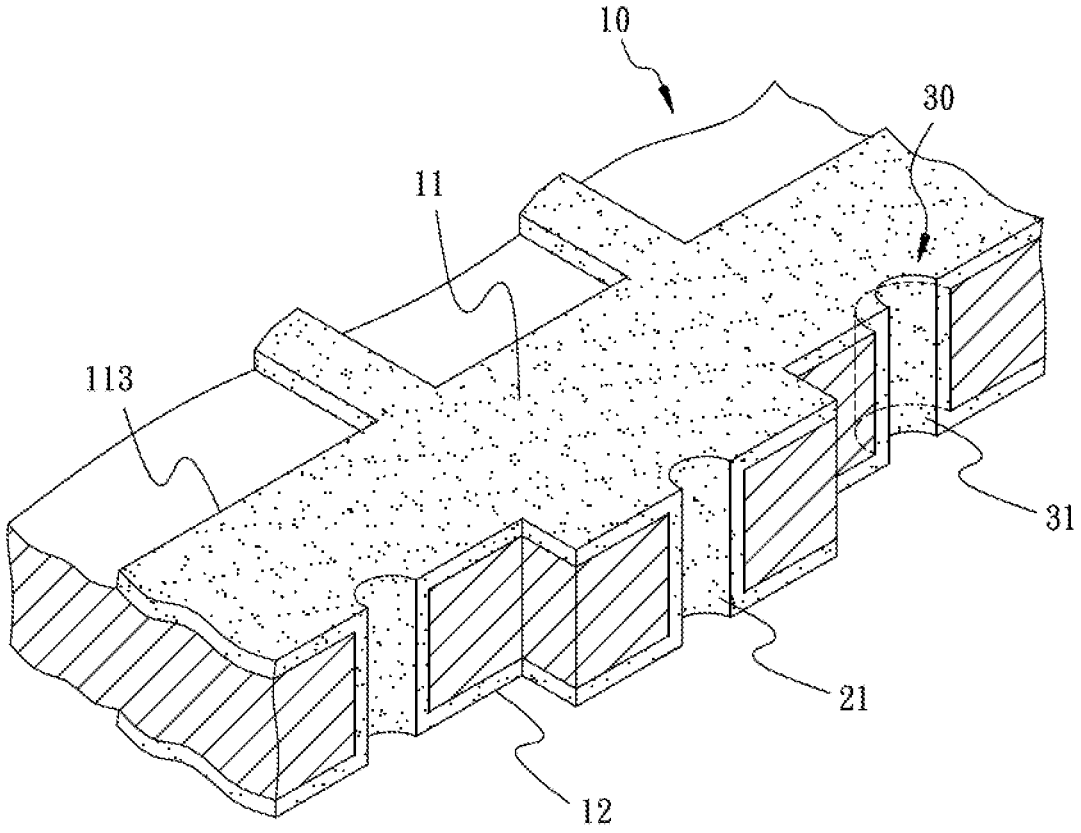
FIG. 3 is a partially cross-sectional view taken along line 3-3 in FIG. 1.

The electric wall 20 includes a plurality of through holes 21 that are equidistantly disposed along the two travelling wave sides 113. The space between two neighboring through holes is defined as a first interval S1, wherein each first interval S1 is 0.1 times the wavelength of the imputed electromagnetic wave. Each through hole 21 is disposed to pass through the first metal layer 11, the second metal layer 12, and the dielectric substrate 10, as shown by FIG. 3. The electric wall 20 is spaced with one reflection bore array 30 by a first length L1, wherein the first length L1 is also equal to the width of the first antenna channel 13 and the second antenna channel 14. Also, each through hole 21 is plated with a metal material. In the embodiments of the present invention, each through hole 21 is plated with copper material.

Figure 4:
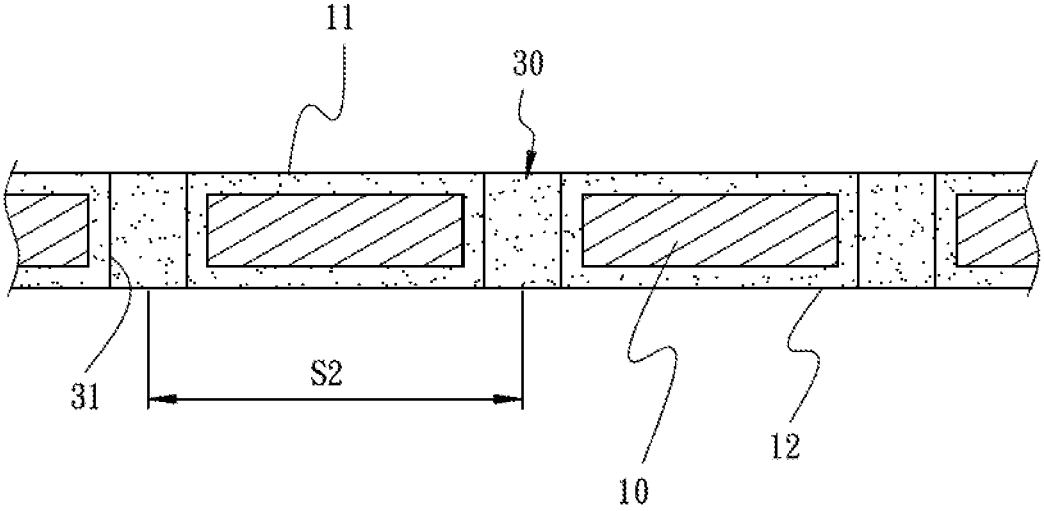
FIG. 4 is a partially cross-sectional view taken along line 4-4 in FIG. 1.
Figure 5:
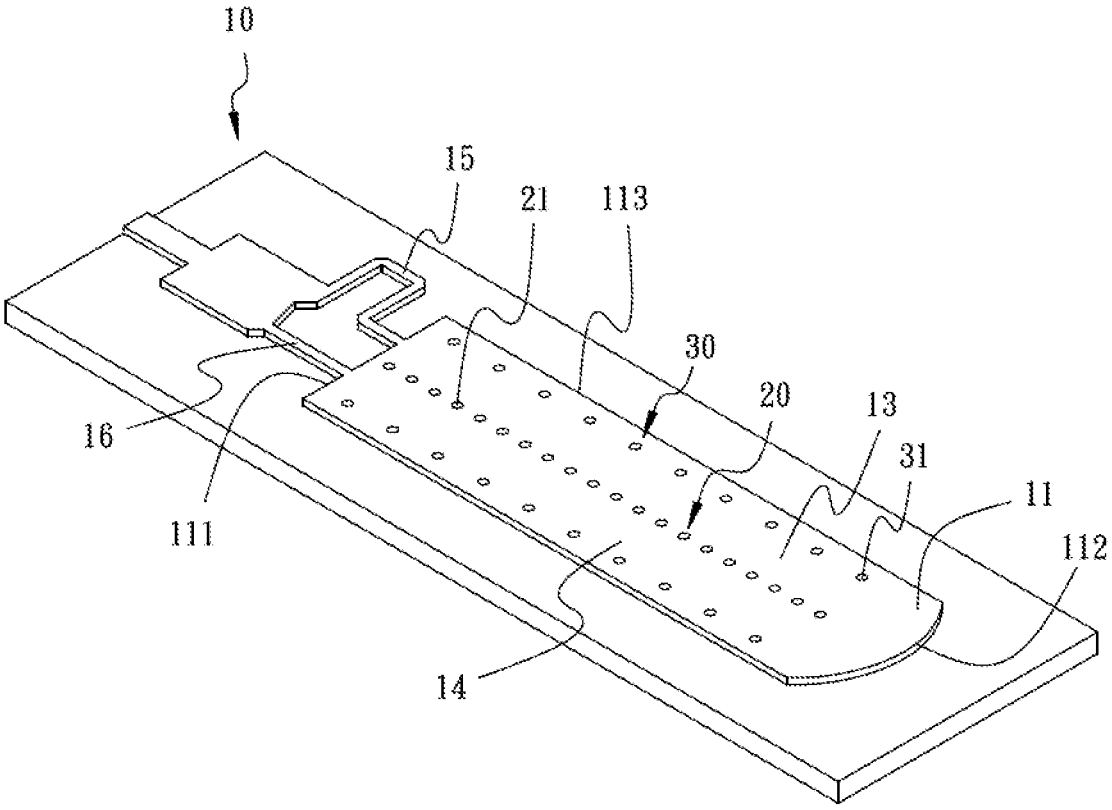
FIG. 5 is a perspective view of the symmetric leaky wave antenna in accordance with the second embodiment of the present invention, illustrating the closed end formed in an arc shape.
Figure 6:
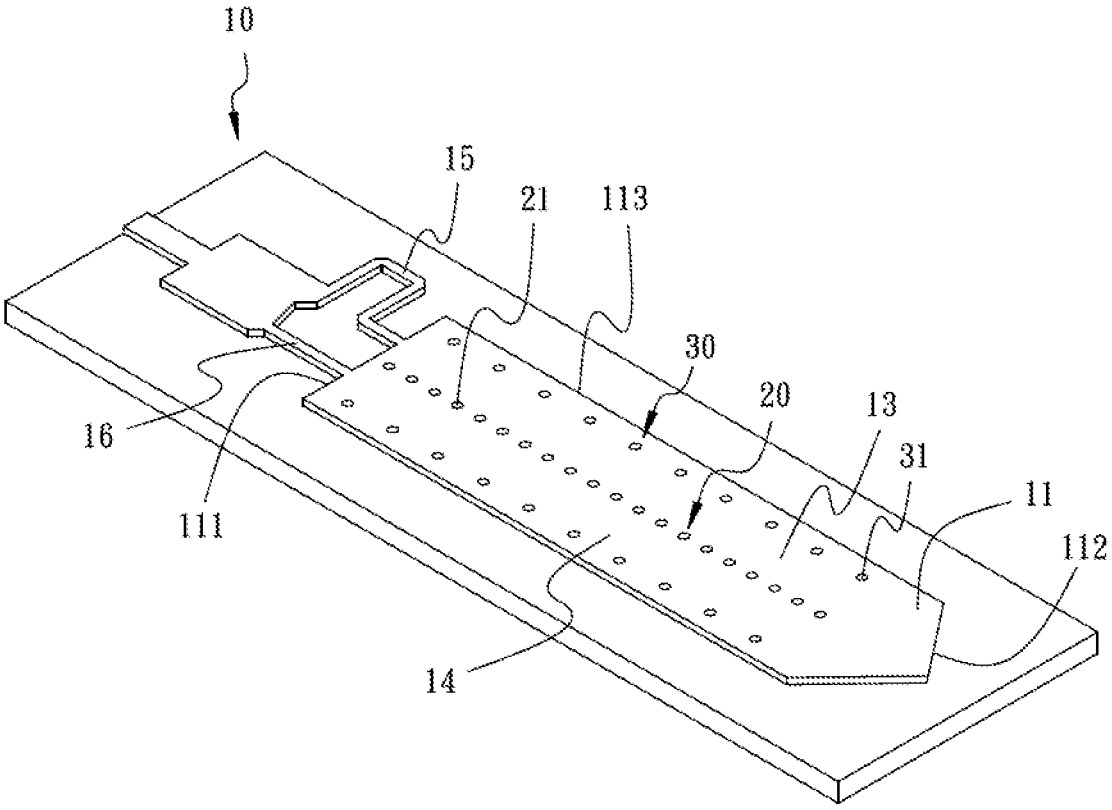
FIG. 6 is a perspective view of the symmetric leaky wave antenna in accordance with the third embodiment of the present invention, illustrating the closed end formed in an angular shape.

The two reflection bore arrays 30 are symmetrically disposed with respect to the electric wall 20 along the two travelling wave side 113, such that the electric wall 20 is arranged at the central line between the two reflection bore arrays 30. The reflection bore arrays 30 pass through the first metal layer 11, the second metal layer 12, and the dielectric substrate 10, as shown by FIG. 3 and FIG. 4. In addition, the two reflection bore arrays 30 includes a plurality of reflection bores 31, wherein the reflection bores 31 are equidistantly disposed along the two travelling wave side 113, wherein each two neighboring reflection bores 31 are spaced by a second interval S2, such that the gain value of the leaky wave antenna is decided by the size of the second interval S2. The second interval S2 is larger than the first interval S1. Furthermore, each reflection bore 31 is plated with metal material. In the embodiments of the present invention, each reflection bore 31 is plated with copper material.

Beside, one reflection bore array 30 is spaced with the adjacent travelling wave side 113 by a second length L2, wherein the first length L1 is not equal to the second length L2. In the embodiments of the present invention, the first length L1 is larger than the second length L2.

With such configuration, the present invention achieves following objectives.

When the electromagnetic wave enters the first antenna channel 13 through the first feed line 15 and the second antenna channel 14 through the second feed line 16, radiation is continuously produced from the travelling sides 113. During the process of the electromagnetic wave producing the radiation, the two reflection bore arrays 30 and the electric wall 20 reduce the leakage rate of the electromagnetic wave, so as to increase the gain value of the leaky wave antenna in accordance with the embodiments of the present invention.

With the two reflection bore arrays 30 symmetrically disposed with respect to the electric wall 20, the radiation pattern is symmetrically arranged, so as to focus the radiation pattern and improved the energy transmission.

With the tapering arrangement of the closed end 112, the electromagnetic wave passing the first antenna channel 13 and the second antenna channel 14 that are having a 180 degrees phase difference are nullified with each other, so that the reflection caused by residual energy is prevented.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A symmetric leaky wave antenna, comprising:

a dielectric substrate, having a first metal layer disposed on one face of the dielectric substrate and a second metal layer disposed on another face of the dielectric substrate in opposite to the first metal layer, respectively, the first metal layer having a feed end and two travelling wave sides, the two travelling wave sides connected to two ends of the feed end, respectively, and the two travelling sides extending toward a direction away from the feed end;

an electric wall disposed between two travelling wave sides, with the two travelling wave sides symmetrically disposed with respect to the electric wall; and two reflection bore arrays symmetrically disposed along the two travelling wave sides, respectively, such that the electric wall is arranged at a central line between the two reflection bore arrays; the two reflection bore arrays passing through the first metal layer, the second metal layer, and the dielectric substrate.

2. The symmetric leaky wave antenna of claim 1, wherein the two reflection bore arrays include a plurality of reflection bores; the reflection bores are equidistantly disposed along the two travelling wave sides, respectively.

3. The symmetric leaky wave antenna of claim 2, wherein the electric wall includes a plurality of through holes, the through holes are equidistantly disposed along the two travelling wave sides, the through holes passing through the first metal layer, the second metal layer, and the dielectric substrate.

4. The symmetric leaky wave antenna of claim 3, wherein each two neighboring through holes are spaced by a first interval, each two neighboring reflection bores are spaced by a second interval, and the second interval is larger than the first interval.

5. The symmetric leaky wave antenna of claim 3, wherein each reflection bore is plated with metal material, and each through hole is plated with metal material.

6. The symmetric leaky wave antenna of claim 1, wherein an end of the first metal layer away from the feed end has a closed end, the closed end connected with the two travelling wave sides, and the closed end being formed in a tapering shape.

7. The symmetric leaky wave antenna of claim 6, wherein the closed end is formed in a shape selected from a group consisting of arc shape, semi-circular shape, or symmetric angular shape.

8. The symmetric leaky wave antenna of claim 1, wherein the feed end is connected with a first feed line and a second feed line, and a length of the first feed line is not equal to a length of the second feed line.

9. The symmetric leaky wave antenna of claim 8, wherein a first antenna channel is formed between one of the travelling wave sides and the electric wall, a second antenna channel is formed between the other one of the travelling wave sides and the electric wall, an end of the first feed line is connected with a section of the feed end corresponding to the first antenna channel, and an end of the second feed line is connected with a section of the feed end corresponding to the second antenna channel.

10. The symmetric leaky wave antenna of claim 1, wherein the electric wall is spaced with one of the reflection bore arrays by a first length, one of the two reflection bore arrays is spaced with the adjacent travelling wave side by a second length, and the first length is not equal to the second length.

11. The symmetric leaky wave antenna of claim 10, wherein, the first length is larger than the second length.

* * * * *